United States Patent [19]

Roper

[11] 4,138,961

[45] Feb. 13, 1979

[54] VESSEL FOR CARRYING STEEL SLABS

[75] Inventor: Howard F. Roper, Upwey, Australia

[73] Assignee: The Broken Hill Proprietary Company Limited, Victoria, Australia

[21] Appl. No.: 771,325

[22] Filed: Feb. 23, 1977

[30] Foreign Application Priority Data

Feb. 23, 1976 [AU] Australia ..... PC4947

[51] Int. Cl.[2] ..... B63B 25/00

[52] U.S. Cl. ..... 114/72; 114/73; 214/14; 214/15 D

[58] Field of Search ..... 114/72, 73, 75, 26, 114/34, 258, 260, 201 R, 203; 214/15 R, 15 D, 12, 14

[56] References Cited

U.S. PATENT DOCUMENTS

| | | | |
|---|---|---|---|
| 2,539,168 | 1/1951 | Smith et al. | 114/72 |
| 2,988,036 | 6/1961 | Mooneyhan et al. | 214/15 R |
| 3,147,728 | 9/1964 | Ishii et al. | 114/72 X |
| 3,437,066 | 4/1969 | Schwendtner | 214/15 R |
| 3,515,086 | 6/1970 | Auzins et al. | 114/260 |
| 3,572,274 | 3/1971 | Brauer et al. | 114/260 |
| 3,687,309 | 8/1972 | Macrander | 114/260 |
| 4,067,284 | 1/1978 | Yasushi et al. | 114/260 |

*Primary Examiner*—Trygve M. Blix
*Assistant Examiner*—Sherman D. Basinger
*Attorney, Agent, or Firm*—Cushman, Darby & Cushman

[57] ABSTRACT

A vessel for carrying steel slabs or like cargoes, comprising a hull having a stern and a bow, an upper weather deck at least one cargo hold, an opening predominantly through the weather deck and communicating with the interior of the hull of the vessel, loading apparatus to transfer slabs to, and from, a wharf through the opening, at least one conveyor extending longitudinally of the vessel and past the cargo hold, the loading apparatus being adapted to deliver slabs to, and from, the conveyor, and a load transport crane within the vessel for transferring the slabs between the conveyor and the cargo hold. In a variation the weather deck has openings which are aligned with the openings to the cargo holds to allow a bulk commodity to be carried by the vessel.

14 Claims, 6 Drawing Figures

20
21
24
31
32
33
43
45
46
69

20
21
24
25
29'
30'
31
32
33
42
43
45
4
62
64
65
66
69

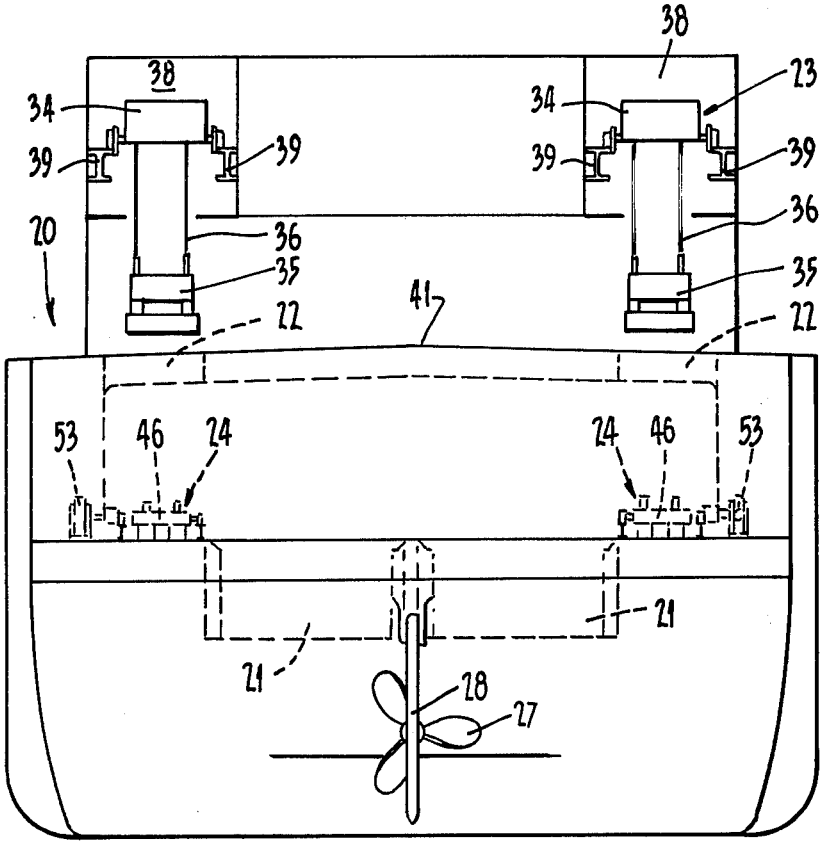
FIG. 3.
FIG. 4.
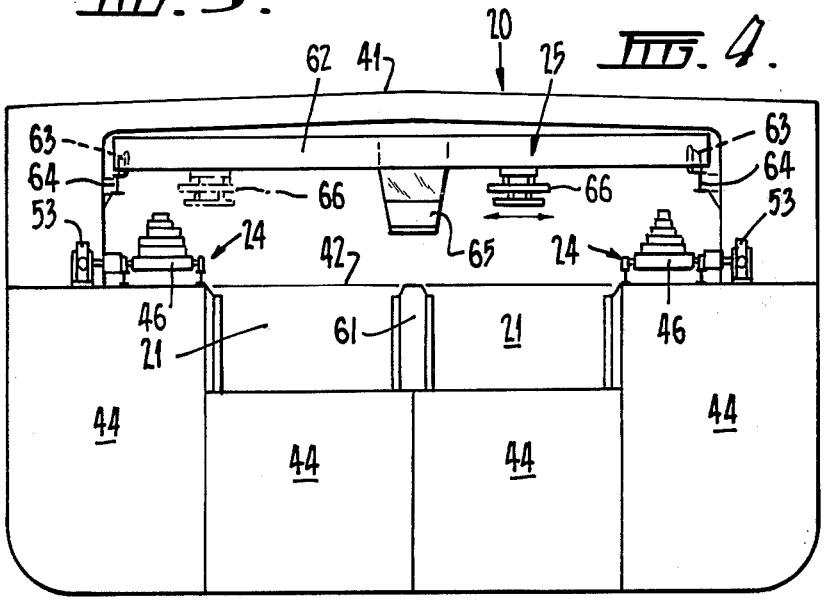

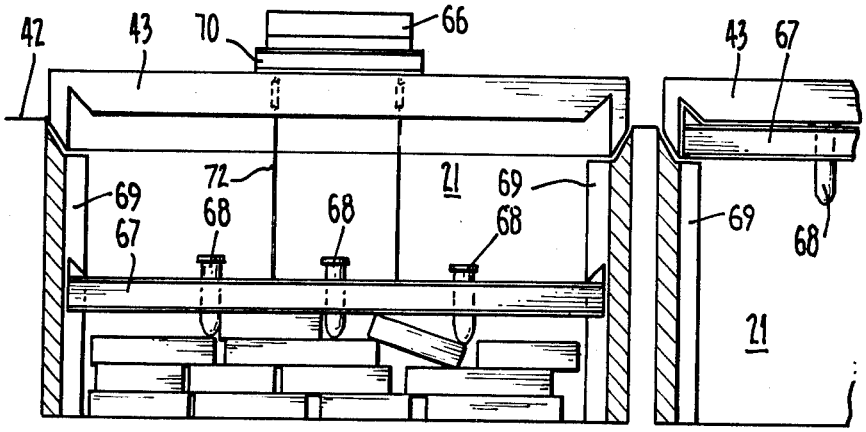
FIG. 10.
FIG. 11.
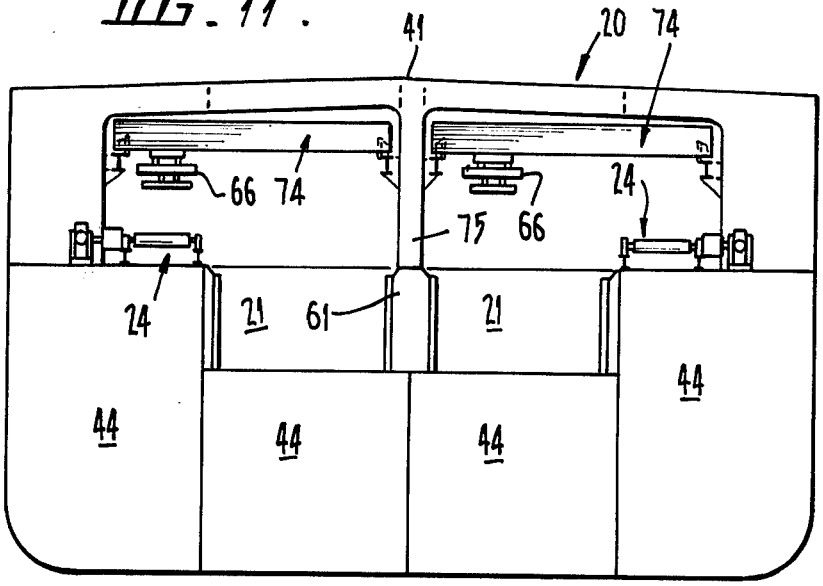

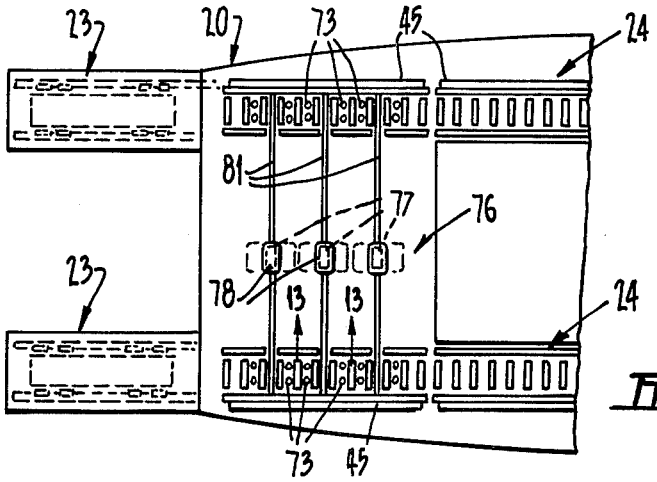
FIG. 12.
FIG. 13.
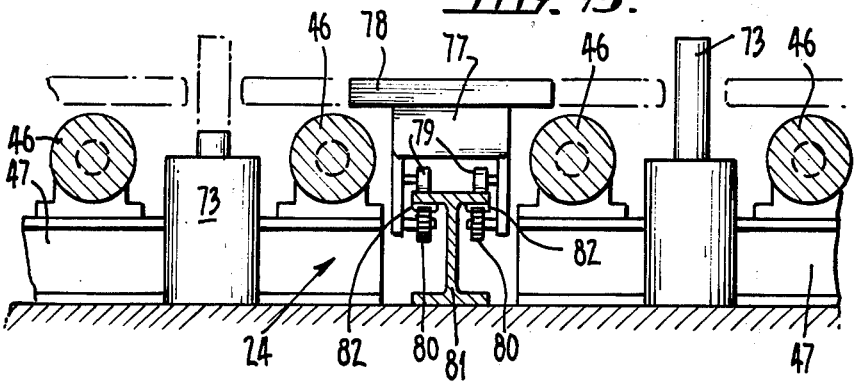
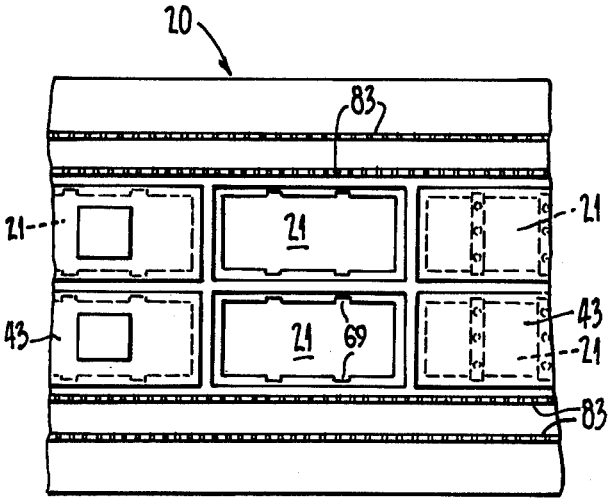
FIG. 14.

VESSEL FOR CARRYING STEEL SLABS

This invention relates to improvements in vessels for carrying steel slabs and other similar cargoes. The present invention is basically applicable for carrying steel slabs, but in one preferred form of the invention the vessel may not only provide for the carrying of steel slabs from a steel slab allows the carrying of an alternative cargo, for example, a bulk commodity such as limestone or iron ore, on the return trip to the steel slab loading port, the advantages of which from an efficiency point of view will be readily apparent.

BACKGROUND OF THE INVENTION

In the past various shipyards have devoted considerable time to the development of a slab carrying vessel having a capacity of in the order of 17,000 tonnes deadweight. The field of study was restricted to a roll-on roll-off vessel of the type described in relation to the "Iron Monarch" cargo vessel in the January, 1974 edition of "The Motorship" in pages 471 to 476 thereof, which includes extracts from a paper entitled "The design, construction and Operation of "Iron Monarch"" by R. J. Stavey and R. G. McLennan. In this type of prior art vessel a straddle carrier is utilised for collecting steel slabs from the dock and carrying it up an angled stern ramp, normally stowed in an upright position adjacent the stern of the vessel, and through a stern door to a vehicle deck in the interior of the vessel where it was transferred to bolsters which in turn were collected by overhead cranes for stowage, 6 high below the vehicle deck and 3 high above the vehicle deck, in a cellular arrangement of cargo spaces.

However, the above type of known vessel does not readily lend itself to the carriage of heavy steel slabs weighing up to 30 tonnes and not necessarily of the same cross-section or length.

SUMMARY OF THE INVENTION

Therefore for the type of cargo envisaged the vessel according to the present invention incorporates a new type of cargo transfer and storage system, and was developed with a view of keeping construction expenses to a minimum.

The primary objective of the invention is to provide a vessel for carrying steel slab or like cargoes comprising at least one cargo hold, an opening to the interior of the vessel, loading means to transfer slabs to, and from, a wharf through said opening, at least one conveyor means extending longitudinally of the vessel and past the, or each, cargo hold, with said loading means being such as to deliver said slabs to, and from, said conveyor, and load transport crane means within said vessel for transferring said slabs between said conveyor means and said cargo hold.

Preferably the opening to the interior of the vessel is an opening through the weather deck at the stern (hereinafter referred to as a stern opening not to be confused with an opening through the transom), and said loading means delivers the slabs to, and from, the stern end of the conveyor means.

In one preferred form of the vessel of the loading means comprises one or more cranes supported adjacent the stern of the vessel and adapted to collect slabs from the wharf and move them through the stern opening and deposit them on the rear end of the conveyor means.

Alternatively, in another preferred form of the invention, the loading means may comprise wharf mounted conveyor means adapted to cooperate at the stern opening with the stern end of the conveyor means.

In another alternative loading could be achieved at the stern opening directly onto the conveyor means by shore cranes or gantries, or in a still further arrangement the loading opening may be in a side of the vessel and at right angles to the vessel keel.

Also, in one preferred form of the invention, the vessel incorporates two decks one above the other, the upper one of which provides a weather deck and the lower one of which is situated over the cargo hold or holds and has openings therethrough adapted to be covered by hatch covers, whilst the space between the upper and lower decks houses the conveyor means and the load transporter crane means.

According to one aspect, the invention incorporates an upper unbroken deck, that is, the upper deck has no openings therethrough with associated hatch covers, whilst the lower or tonnage deck has openings therethrough with associated hatch covers, which openings communicate with a series of cargo holds below. This aspect of the invention has been primarily designed for a vessel of in the order of 18,000 tonnes deadweight and including at least 8 separate cargo holds.

The load transport crane means are provided by three overhead electric cranes which run on tracks within the space between the upper and lower decks. In this aspect of the invention the cargo holds are only required to carry steel slabs, and are shallow in depth and are only required to extend across the centerline of the vessel a distance of about half the ships breadth, thus ensuring that the centre of gravity of a block of stowed slabs does not place the centre of gravity too low in the vessel as to create "over" stable conditions resulting in a heavy righting movement.

According to a second aspect of the invention, to avoid limiting use of the vessel to only a one way steel slab carrying trade, the design is modified to enable the vessel to return to the steel slab loading port carrying a bulk commodity such as limestone or iron ore. With this second aspect of the invention the cargo holds are deeper and wider, but the vessel would carry slabs in alternate cargo holds only, thus maintaining the center of gravity of the stowed cargo as in the first aspect of the invention. With this second aspect of the invention the upper weather deck has openings provided therethrough with associated hatch covers to allow the vessel to also be loaded, when appropriate, with a homogeneous cargo in all holds. The cargo would only be loaded to the top of each cargo hold adjacent the lower tonnage deck, and although it may not be possible to acquire a full deadweight of limestome, a full deadweight of iron ore should be readily achieved.

In practice the steel slabs may be transferred to the vessel in packs or bundle form and deposited in the cargo holds one by one, although they may equally well, and in some cases more easily, be transferred to the vessel one by one.

DETAILED DESCRIPTION OF THE INVENTION

Figures 1A, 2A:
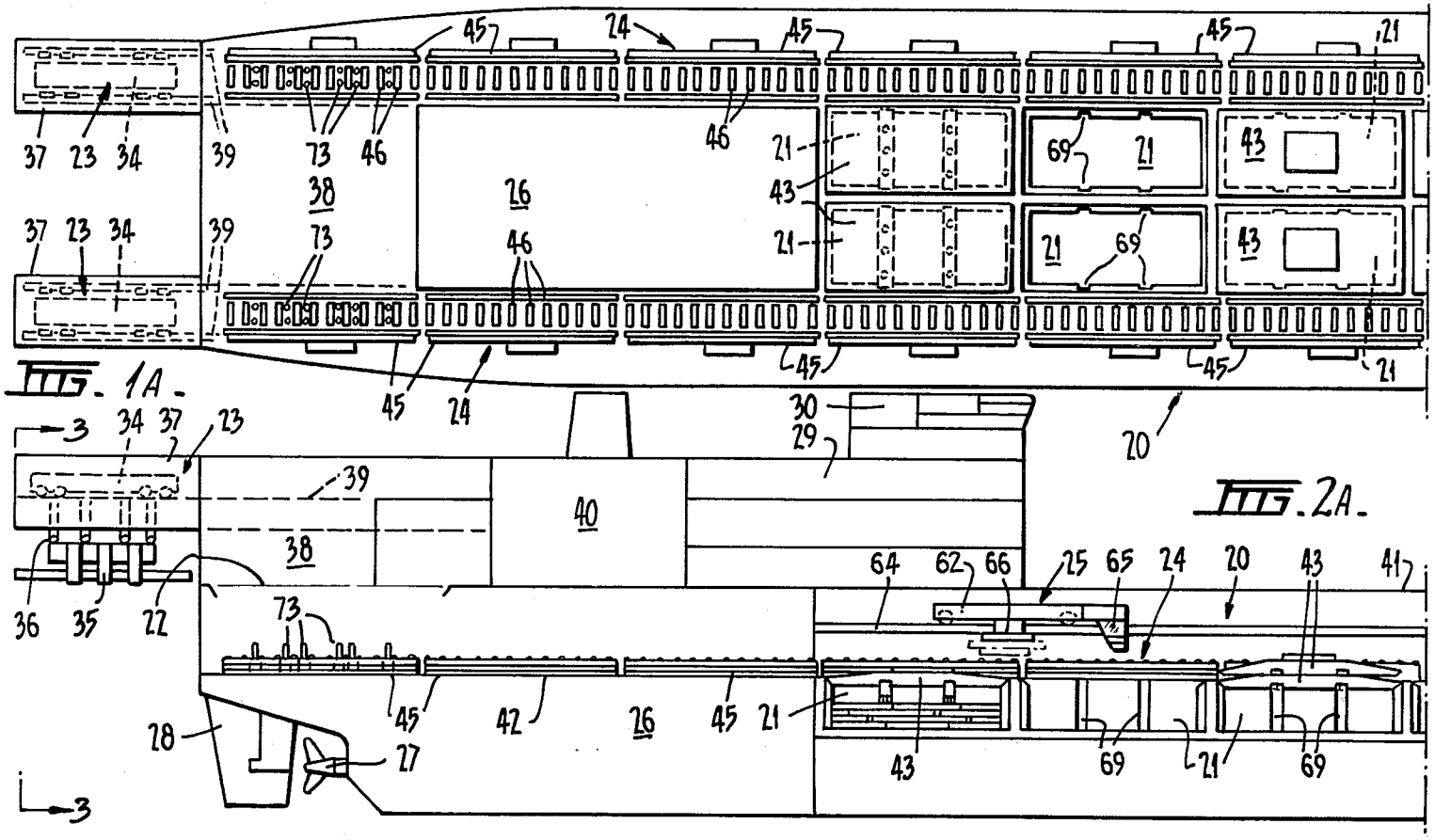
Figure 1B:
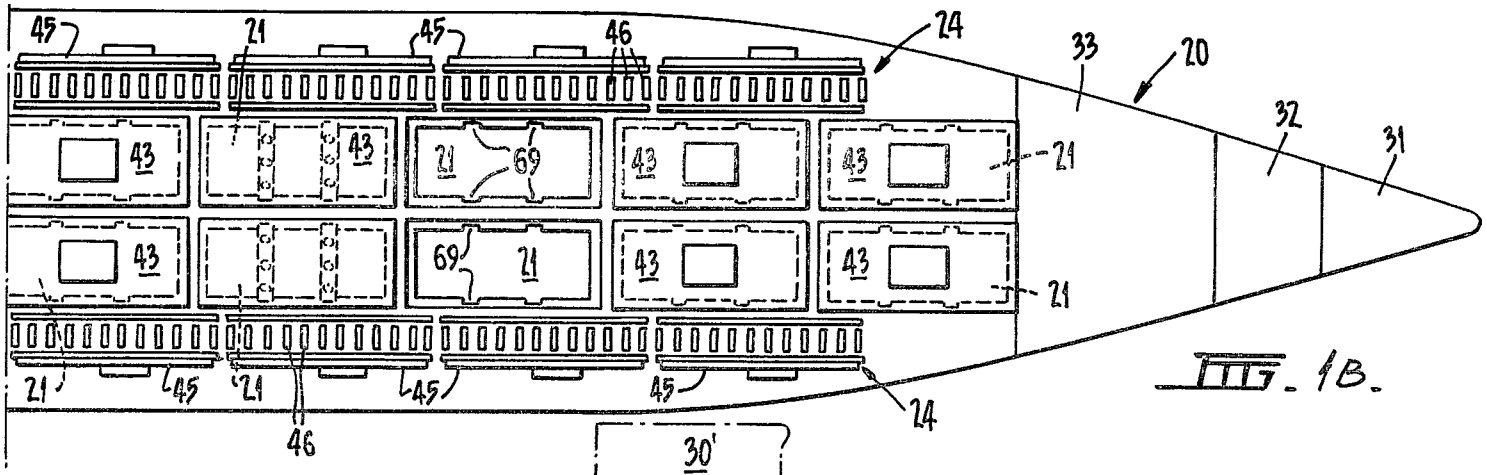
Figure 2B:
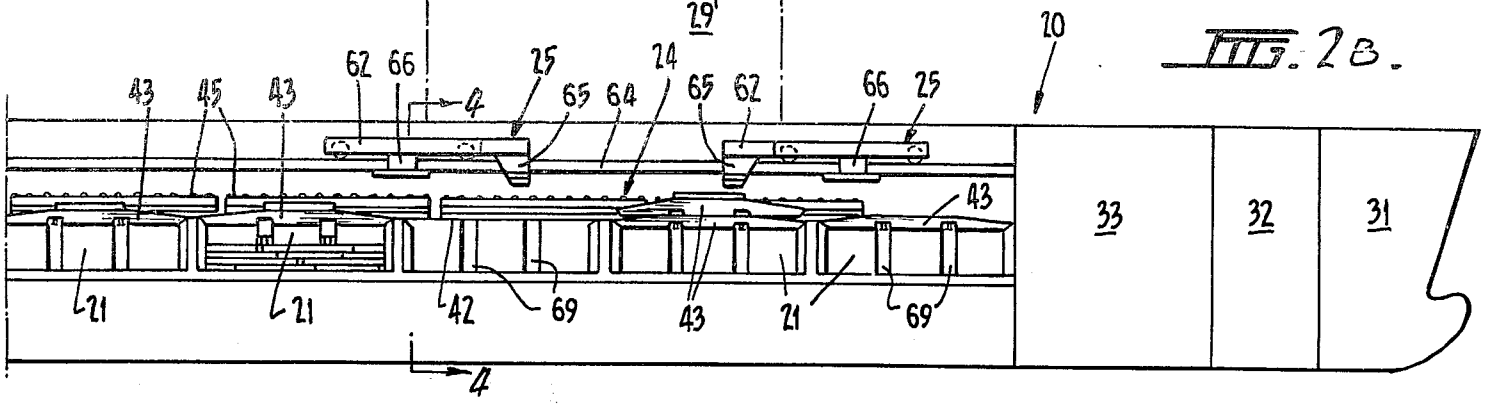
Figures 5, 6, 7:
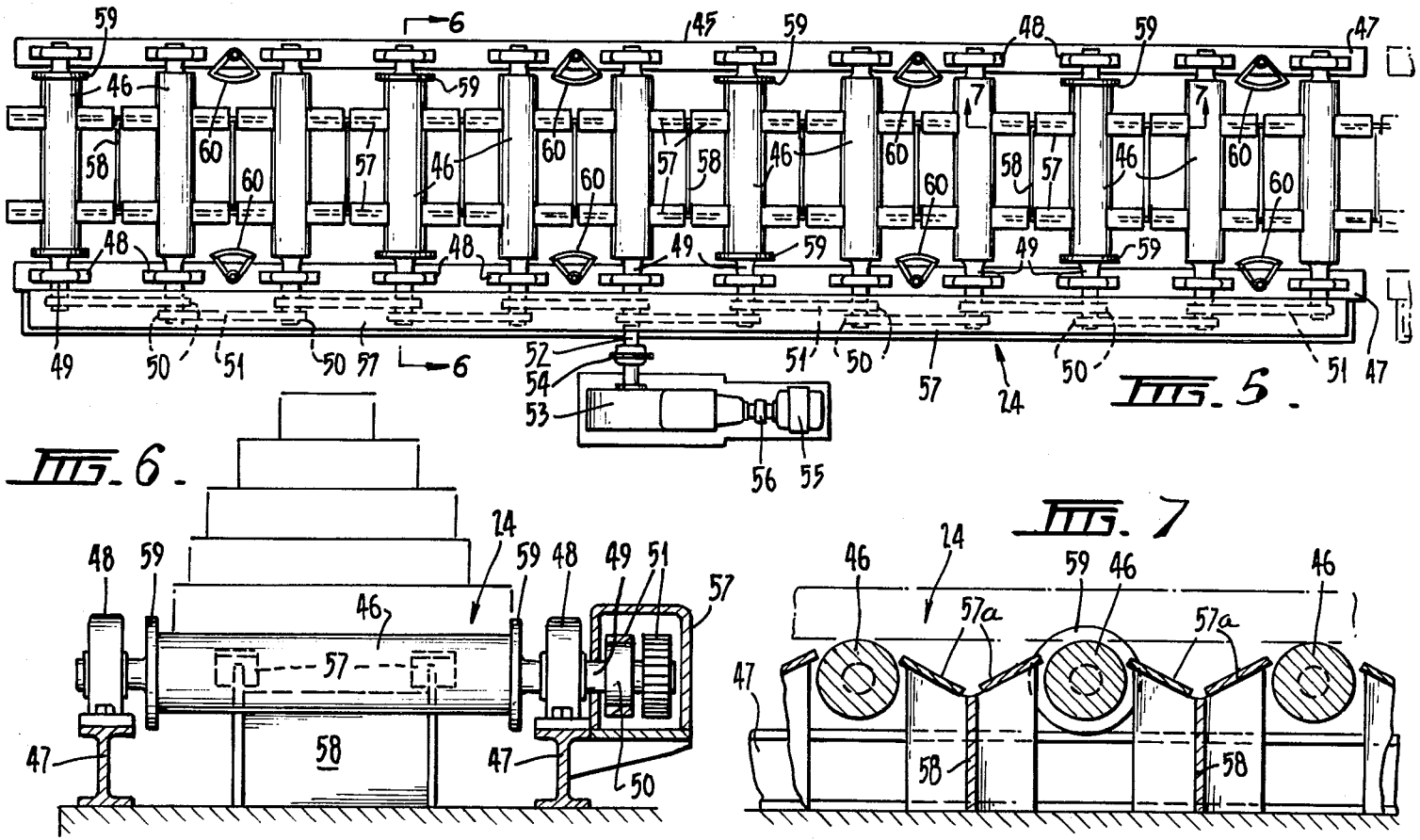
Figure 8:
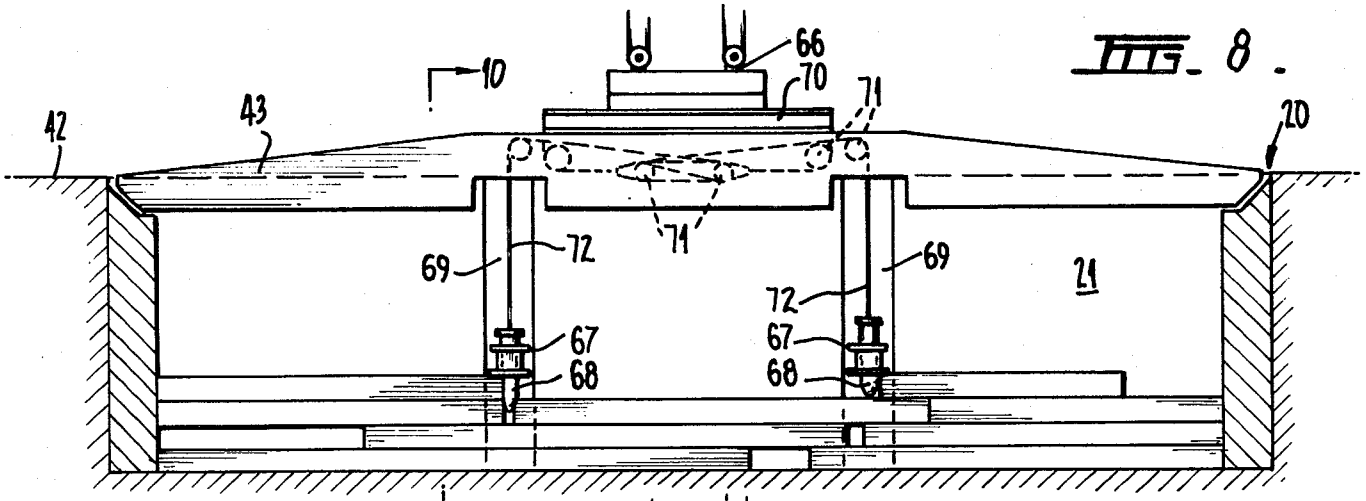
Figure 9:
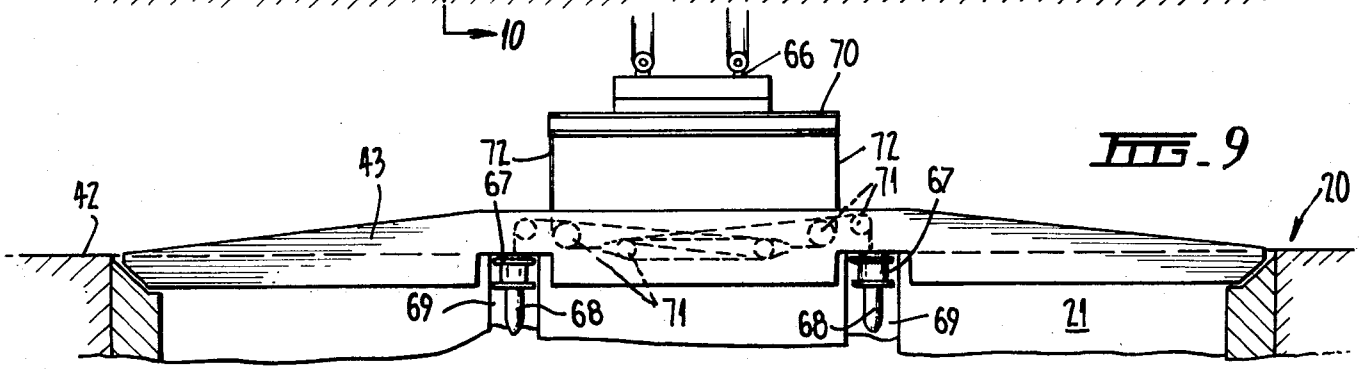

One preferred form of the invention, and several modifications thereof, will now be described with reference to the accompanying drawings in which:

FIG. 1A is a plan view of the stern section of the vessel of this preferred form of the invention from the stern to a position approximately mid-ships, FIG. 1B is a plan view of the bow section of the vessel of FIG. 1A from approximately mid-ships to the bow, FIG. 2A is a side elevational view of the stern section of FIG. 1A, FIG. 2B is a side elevational view of the bow section of FIG. 1B, FIG. 3 is an end elevational view in the direction of line 3—3 in FIG. 2A, FIG. 4 is a cross-sectional view taken along line 4—4 of FIG. 2B, FIG. 5 is a detailed plan view of portion of one of the roller conveyors shown in FIGS. 1A and 1B extending longitudinally of the vessel, FIG. 6 is a cross-sectional view taken along line 6—6 of FIG. 5, FIG. 7 is a cross-sectional view taken along line 7—7 of FIG. 5, FIG. 8 is an end elevational view of the slab retaining beam assembly cooperating with the hatch covers of the cargo holds, FIG. 9 is a view similar to that of FIG. 8 showing the beam assembly in a raised position, FIG. 10 is a side elevational view of the beam arrangement of FIGS. 8 and 9, FIG. 11 is a cross-sectional view through a modified cargo hold and transfer crane arrangement, FIG. 12 is a view of a modified form of the stern section of the conveyor means incorporating provision to transfer slabs from one side of the vessel to the conveyor on the other side of the vessel, FIG. 13 is a cross-sectional view taken along line 13—13 of FIG. 12, and FIG. 14 is a detailed plan view of a modified vessel incorporating a chain conveyor means as an alternative to the roller conveyor means of the previous embodiments.

In accordance with the basic requirements of the invention the vessel, generally indicated as 20, the stern and forward sections of which are shown in FIGS. 1A and 2A of FIGS. 1B and 2B respectively, includes a total of 16 cargo holds 21 in this preferred embodiment of the invention, in pairs on either side of the centerline of the vessel as shown with the combined width of each respective pair of cargo holds being about half the vessel's breadth. As mentioned previously, this ensures that the center of gravity of a block of stowed slabs does not place the center of gravity too low in the ship to create "over" stable conditions resulting in a heavy righting movement. A pair of stern openings 22 are also provided through the weather deck on either side of the vessel at the stern and, although the openings are above the water-line for the vessel, weather-proof hatches are utilised to close these openings when the vessel is not being loaded or unloaded. The loading means of the present invention are generally indicated as 23, whilst the conveyor means in this embodiment include a pair of roller conveyors generally indicated as 24 which extend longitudinally of the vessel parallel to the keel from a position adjacent the stern loading means 23 as shown in FIGS. 1A and 2A to a position adjacent the forward most cargo hold 21 as shown in FIGS. 1B and 2B. Load transporter means in the form of 3 Safe Working Load cranes 25 are supported to be movable longitudinally of the vessel and incorporate load engaging means which are adapted to move transversely of the vessel between positions over the respective roller conveyors 24 and the cargo holds 21.

The general arrangement of super-structure of this ship will not be described in detail as the general requirements, with regard to the conventional requirements for vessels, will be readily apparent to those skilled in the art, but it will suffice to say that the stern section of the vessel incorporates an engine room 26 with an engine casing 40, which engine room provides propulsion for the vessel through a propeller 27 adjacent the rear of which a rudder assembly 28 is positioned. As shown, the stern section also includes an accommodation section 29 with a control bridge 30. However, as shown in FIG. 1B, the accommodation section and the control bridge may be positioned in an alternative forward position as shown in phantom lines as 29' and 30'.

As shown in FIGS. 1B and 2B the forward, or bow section, incorporates a forepeak 31, a bow thrust and pump room 32 and a deep tank chamber 33.

Referring to FIGS. 1A, 2A and 3 of the drawings, the stern loading means 23 consists of a pair of 125 tonne S.W.L. cranes incorporating a bogie 34 from which sets of scissor tongs 35 are supported by an arrangement 36 of lifting cables such as to allow steel slabs to be lifted from the wharf to an elevated position as shown in FIG. 2A whereafter the bogie 34 is moved on supporting rails 39 to a position within the stern section of the vessel. As shown the vessel is modified to incorporate a pair of cantilever crane support housing sections 37 communicating with an interior loading room 38 situated over the rear ends of the roller conveyors 24.

In this embodiment of the invention, the vessel is provided with an upper unbroken weather-deck 41 and a lower tonnage deck 42 incorporating hatch covers 43 covering the cargo holds 21. As shown in FIG. 4 the sides and bottoms of the cargo holds 21 are surrounded by water ballast, or liquid cargo, holds 44.

As shown in FIG. 1A to 4 the roller conveyors 24 are situated on either side of the vessel outboard of the engine room casement 40 but set in far enough to enable the conveyors to extend parallel to the keel with the effective support surface provided by the rollers of the conveyors 24 being nominally above the tonnage deck 42. Each roller conveyor 24 is formed from a plurality of conveyor sections 45, and in this embodiment there are 10 conveyor sections for each conveyor. Each conveyor section 45 includes 12 rollers 46 mounted on longitudinal support members 47 via bearing blocks 48 and each roller has spindle extensions 49 incorporating sprockets 50 whilst a series of drive chains 51 couple successive rollers together and are situated within a housing 57 as shown in FIG. 5 with one of the spindle extensions being coupled to an output shaft 52 from a rigth angle speed reducer 53 via coupling 54, to which speed reducer motive power is provided by an electric motor 55 via a coupling 56.

Referring to FIG. 7 of the drawings, two pairs of angled skid plates **57*a* are supported, via a support member 58, between each successive pair of rollers 46**, and the angle of inclination of the skid plates is such as to be generally tangential to the respective roller surfaces. The skid plates are provided to ensure that there is no jamming or fouling of the leading edges of the steel slabs between successive rollers as they progress along the conveyors, particularly as some of the slabs may have their leading edges bent downwardly as a result of the slab severing operations at the slab forming mills.

In order to keep the slabs aligned with the path of the respective conveyor as they traverse therealong one, or both, of a pair of provisions are utilised, both of which are illustrated for the purposes of this description. One of the provisions requires each third roller 46 to incorporate raised end flanges 59, and, or alternatively, opposed pairs of arcuate members 60 are provided between selected pairs of rollers as shown in FIG. 5.

As shown in FIG. 4, this embodiment of the invention incorporates a plurality of pairs of side by side cargo holds 21, separated by partitioning wall 61 extending along the centerline of the vessel, whilst each load transport crane 25 within the vessel spans the full width of a pair of holds 21 and the roller conveyors 24 on either side thereof, and incorporates a main support beam 62 extending transversely of the vessel within the space between the weather deck and the tonnage deck and movably supported on wheels 63 at either end to enable it to move longitudinally of the vessel on rails 64. As shown, an operator's cabin 65 is suspended from the center of the main support beam 62. A load lifting arrangement 66 is supported by the main beam 62 to traverse back and forth therealong to collect slabs from the two side roller conveyors 24 and deposit them in the cargo holds 21 or vice versa. In this embodiment three inboard cranes 25 are provided one of which normally services four of the pairs of cargo holds towards the bow of the vessel and one of which serves the remaining four pairs of cargo holds, whilst the remaining crane 25 merely provides a back-up should one of the other cranes break down or require maintenance, or in a situation where the supply of steel slabs results in an overfeed not capable of being handled by the other two cranes alone.

Storage of the steel slabs in the cargo holds need not be exact providing the stowage is basically blocked out, as particularly with the centerline dividing partitions 61 as shown in FIG. 4 it is unlikely that any movement of the slabs would take place. However, provision has been made for securing the slabs to prevent all but the slightest movement thereof in the heaviest of seas. This provision is illustrated in FIGS. 8 to 10 of the drawings and basically consists of a pair of slab retaining beams 67 adapted to move between a position received beneath the hatch cover 43 for each hold and a lowered position within the hold. The beams freely support sets of heavy solid pins 68 which are free to adopt any convenient position through the beams in the lowered position thereof as dictated by the orientation of the slabs within the respective cargo holds as shown in FIGS. 8 and 10. The ends of the beams 67 are received, to be guided within, guide slots 69 formed in the side walls of the cargo hold and are supported by a lifting platform 70 adapted to be lifted by the lifting arrangement 66 of the respective inboard cranes 25 from a position adjacent the upper surface of the hatch covers 43 and an elevated position. An arrangement whereby the distance the beams are lifted is magnified in relation to the distance the hatch cover is lifted is utilized (see FIGS. 8 and 9), and is supported by the hatch cover 43 and, as shown, incorporates a pulley 71 and a cable 72, with the cable 72 extending between the lifting platform 70 and the beams 67. As will be evident from the drawings, with such an arrangement, upon coupling the lifting arrangement 66 to the lifting platform 70 (which in one embodiment of the invention may be by virtue of a permanent magnet supported by the lifting arrangement 66 and adapted to engage a metallic lifting platform 70), and raising the arrangement the lifting platform 70 is first raised away from the top surface of the hatch cover and the cables 72 are drawn through the arrangements and lift the beams 67 up to a position beneath the respective hatch cover as shown in FIG. 9. After reaching a position beneath the respective hatch covers the beams 67 upon further lifting of the arrangement 66 enable the whole arrangement of hatch covers and beams to be lifted to a position thereby opening the cargo hold. The arrangement of pulley 71 and cable 72 between the lifting platform 70 and the beams 67 may provide a 3:1 mechanical advantage, whereby lifting of the platform 70 is magnified threefold by the pulley and cable arrangements 71, 72.

With reference to FIGS. 1A, 2A, 12 and 13, the first conveyor section 45 adjacent the stern of the vessel and upon which the load of steel slabs are deposited by the loading cranes 23, incorporate a series of hydraulic load shock absorbing rams 73 upon which the load of slabs are firstly deposited with the rams in the elevated position such that thereafter the slabs may be lowered on the rams to be gently deposited on the conveyor section 45.

As shown in FIG. 13 merely for the purpose of illustration, the left hand ram 73 is shown in the lowered position with its upper end below the level of the roller conveyor, whilst the right hand ram is shown in an elevated position thereof whereby it will intercept and support the load of slabs, before being lowered to the lower position leaving the load supported on the surface of the roller conveyor.

In an alternative embodiment, as shown in FIG. 11, each respective hold 21 on either side of the centerline of the vessel is served by its own individual inboard crane 74, rather than a single crane extending transversely of both holds 21 as previously described. With this form of arrangement, where the cranes only operate over half the width of the vessel, it is clear that should a stern crane break down only one side of the vessel could be loaded. It should be noted that in this alternative embodiment the area above the holds 21 is separated as shown by a central support wall 75. In order to meet the situation where one of the stern crane should break down, this alternative form of vessel incorporates a cross-over slab transfer system within the stern of the ship to transfer slabs, or bundles of slabs, from the conveyor on one side to the conveyor on the other side. In this respect attention is directed to FIGS. 12 and 13 of the drawings in which the transfer system is generally indicated as 76, and comprises three transfer bogies 77 providing upper slab supporting surfaces 78 and supported by guide wheels 79 and drive sprocket pinions 80 on transfer rails 81 having gear racks 82 on the under-surfaces of the upper flanges thereof such as when the drive pinion sprockets 80 are driven by an electric motor (not shown) the respective transfer bogie 77 will traverse across the width of the vessel. In order to facilitate transfer slabs, if already deposited on the roller conveyor 24 on one side of the vessel, may be raised by the rams 73 to an elevated position, or alternatively the rams may be elevated and the stern crane lowers the slabs directly onto the elevated rams. With the slabs in the elevated position on the hydraulic rams 73, the transfer bogies 77 (which are all driven by their respective electric motors via an electrical control circuit which ensures that all motors operate such that the transfer movement of the respective bogies are in unison), are moved into position beneath the slabs, whereafter the rams 73 are lowered leaving the slabs supported on the bogies 77 which are then driven across the vessel to a position above the roller conveyor 24 on the other side. In this position the hydraulic rams for the conveyor on the other side are elevated to take the weight of the slabs, the bogies 77 are driven out from beneath the slabs, and the rams 73 then lower the slabs onto the conveyor.

As an alternative to a roller conveyor 24, other forms of longitudinal conveying means along either side of the vessel may be utilised, such as a chain conveyor shown as 83 in FIG. 14 of the drawings. Alternatively plate conveyors may be utilised.

As shown, the stern cranes 23 incorporate scissor tongs for gripping the bundles of steel slabs, and as an alternative to this the stern cranes may incorporate permanent magnets for holding individual steel slabs rather than bundles, with means for breaking of the magnetic field by passing an electric current adjacent the magnets to counteract their magnetic effect to therefore allow disengagement from a steel slab. As shown, the inboard cranes 25 (FIG. 4) and 74 (FIG. 11) also include lifting arrangements 66 which incorporate similar permanent magnet devices for transferring individual slabs between the side conveyors 24 and the holds 21. Magnetic holding means are preferred as they allow positive engagement of the top surfaces of the slabs thus allowing for close storage of slabs side by side.

Normally, when bundles of steel slabs are being handled, the stern cranes 23 and the side conveyors 24 handle the slab bundle whilst the slabs are transferred from each bundle into the hold one by one by the inboard cranes 62 and 74.

In one loading sequence, the inboard crane 25 adjacent the stern of the vessel loads the first two side by side holds 21 in the first operation with the hatch covers of those holds being previously shifted by the inboard cranes 25 onto the tops of the hatch covers of the longitudinally adjacent holds, and are subsequently replaced after loading of the first pair of holds is completed, whilst a similar procedure is followed for the next pair of side by side holds as is particularly illustrated in FIGS. 1A and 2A. The inboard cranes 25 serving the forward holds follows a similar hold loading procedure. Other loading sequences may be utilised if desired, and it is believed that judicious selection of a loading sequence will enable the handling of up to 1250 tonnes of steel slabs per hour allowing for generous idle time.

Basically the loading procedure involves bringing slabs to the stern of the vessel in bundles or packs of up to 120 tonnes in weight, with the wider slabs being positioned at the bottom of the pack or bundle. The stern cranes 23 which are capable of handling up to 125 tonnes each lift the bundle of slabs up through the stern openings and onto the conveyors 24 where they are transported thereon to adjacent the cargo holds to be loaded. The inboard cranes, which are capable of moving along their respective sections of the cargo holds, collect individual slabs from the bundles on the conveyors and transfer them into the cargo holds.

Preferably the crane operators also control the drives for the side conveyors 24 to allow them to be stopped when required during the loading operation, although if necessary the conveyors may be automatically controlled to stop adjacent the holds to be loaded at any particular time.

The length of the respective cargo holds may be such as to accommodate the longest slabs to be stowed, although the size of the holds will depend on the general structural requirements for the vessel and if possible each hold might accommodate two slabs end to end.

In a more efficient version of the vessel the subject of this invention, where the return trip may be used to transport a bulk commodity, the weather or upper deck has openings therethrough overlying the respective holds as shown in dotted lines in FIGS. 3, 4 and 11, which openings have their own hatch covers. When loading a bulk material, the inboard cranes 25 are used to lift the hatch covers 43 from the holds 21 and to position them on the end most holds whilst loading proceeds, whilst after loading is completed the hatch covers are replaced and the hatch covers from the end most holds are removed to complete loading. Alternatively, the cranes may lift the hatch covers and merely move them out of the way and hold the particular hatch cover until the loading of the associated hold is completed.

I claim:

1. A vessel for carrying steel slabs or like cargoes, comprising a hull, an upper weather deck, at least one cargo hold, an opening predominantly through the weather deck and communicating with the interior of the hull of the vessel, loading means to transfer slabs to, and from, a wharf through said opening, at least one conveyor means extending longitudinally of the vessel and past the cargo hold, said loading means being adapted to deliver slabs to, and from, said conveyor means, and load transport crane means within said vessel for transferring said slabs between said conveyor means and the cargo hold, and wherein the loading means is at least one loading crane suspended from a cantilever supported structure extending beyond the stern of the vessel, and said loading crane is adapted to more lengthwise of the vessel between a position suspended over said wharf, to collect slabs, and a position over said opening whereby said slabs are delivered through said opening onto the stern ends of the conveyor means within the interior of said vessel.

2. A vessel as claimed in claim 1, wherein said conveyor means includes at least one roller conveyor.

3. A vessel for carrying steel slabs or like cargoes, comprising a hull, an upper weather deck, at least one cargo hold, an opening predominantly through the weather deck, and communicating with the interior of the hull of the vessel, loading means to transfer slabs to, and from, a wharf through said opening, at least one conveyor means extending longitudinally of the vessel and past the cargo hold, said loading means being adapted to deliver slabs to, and from, said conveyor means, and load transport crane means within said vessel for transferring said slabs between said conveyor means and the cargo hold, and wherein the cargo hold has an associated hatch cover and lifting means are provided to raise and lower said hatch cover, and retaining means are provided comprising a plurality of beams with retaining pins therethrough associated with said hatch cover such as to be raised to a position adjacent the undersurface of the hatch cover when said lifting means raise the hatch cover from the cargo hold and a position suspended beneath said hatch cover with said pins engaging with said stowed slabs to substantially retain them in position when said lifting means lowers said hatch cover into position covering the opening to said cargo hold.

4. A vessel as claimed in claim 3, wherein said conveyor means includes at least one roller conveyor.

5. A vessel for carrying steel slabs or like cargoes, comprising a hull having a stern and a bow, an upper weather deck, at least one cargo hold, an opening adjacent the stern of the vessel and predominantly through the weather deck, and communicating with the interior of the hull of the vessel, two loading cranes supported adjacent the stern of the vessel to transfer slabs to, and from, a wharf through said opening, two conveyors extending longitudinally of the vessel parallel to the keel thereof on either side of an engine casing within the vessel and the cargo hold, said loading cranes being adapted to deliver slabs to, and from, the stern end of a respective conveyor means, and load transport crane means within said vessel for transferring said slabs between said conveyor means and the cargo hold, and wherein each loading crane is suspended from a cantilever supported structure extending beyond the stern of the vessel, and said loading cranes are adapted to move lengthwise of the vessel between a position suspended over said wharf, to collect slabs, and a position over said opening whereby said slabs are delivered through said opening onto the stern ends of the conveyor means within the interior of said vessel.

6. A vessel as claimed in claim 5, wherein said conveyors are roller conveyors.

7. A vessel for carrying steel slabs or like cargoes, comprising a hull having a stern and a bow, an upper weather deck, a lower tonnage deck and at least one cargo hold, an opening predominantly through the weather deck, and communicating with the interior of the hull of the vessel with said tonnage deck having openings therethrough for the cargo hold, loading means to transfer slabs to, and from, a wharf through said opening, at least one conveyor means extending longitudinally of the vessel in the space between said weather deck and said tonnage deck and past the cargo hold, said loading means being adapted to deliver slabs to, and from, said conveyor means, and load transport crane means in the space between said weather deck and said tonnage deck for transferring said slabs between said conveyor means and the cargo hold.

8. A vessel as claimed in claim 7, wherein said weather deck is an unbroken deck and the vessel is utilized for carrying only steel slabs or like cargoes.

9. A vessel as claimed in claim 7, wherein said weather deck includes at least one opening therethrough adapted to align with an associated opening in said tonnage deck and communicating with an associated cargo hold, whereby said vessel may also be utilized for carrying a bulk commodity which is loaded into, or unloaded from, each cargo hold through the openings in said weather deck.

10. A vessel as claimed in claim 7, wherein said conveyor means includes at least one roller conveyor.

11. A vessel for carrying steel slabs or like cargoes, comprising a hull having a stern and a bow, an upper weather deck, at least one cargo hold, an opening adjacent the stern of the vessel and predominantly through the weather deck, and communicating with the interior of the hull of the vessel, two loading cranes supported adjacent the stern of the vessel to transfer slabs to, and from, a wharf through said opening, two conveyors extending longitudinally of the vessel parallel to the keel thereof on either side of an engine casing within the vessel and the cargo hold, said loading cranes being adapted to deliver slabs to, and from, the stern end of a respective conveyor means, and load transport crane means within said vessel for transferring said slabs between said conveyor means and the cargo hold, and wherein said vessel carries a stern transfer device designed to collect slabs from one side of said vessel and transfer them across the stern of the vessel and onto the conveyor means on the other side of said vessel.

12. A vessel as claimed in claim 11, wherein said conveyors are roller conveyors.

13. A vessel for carrying steel slabs or like cargoes, comprising a hull having a stern and a bow, an upper weather deck, at least one cargo hold, an opening predominantly through the weather deck, and communicating with the interior of the hull of the vessel, loading means to transfer slabs to, and from, a wharf through said opening, at least one conveyor means extending longitudinally of the vessel and past the cargo hold, said loading means being adapted to deliver slabs to, and from, said conveyor means, and load transport crane means within said vessel for transferring said slabs between said conveyor means and the cargo hold, and wherein a portion of the conveyor means upon which the loading crane means deposits said slabs incorporates ram means which in an elevated position extend above the conveyor surface of said conveyor means and upon which said slabs are deposited by the loading crane means, whereby upon subsequent lowering of said ram means to a position beneath said conveyor surface said slabs are deposited on said portion of said conveyor means.

14. A vessel as claimed in claim 13, wherein said conveyor means includes at least one roller conveyor.

* * * * *